US005645163A

United States Patent [19]

Werth

[11] Patent Number: 5,645,163

[45] Date of Patent: Jul. 8, 1997

[54] DETACHABLE MULTI-UNIT PACKAGE HAVING INTERNAL HANDLE

[75] Inventor: Elmer D. Werth, Arvada, Colo.

[73] Assignee: Material Savers, Inc., Denver, Colo.

[21] Appl. No.: 560,347

[22] Filed: Nov. 17, 1995

Related U.S. Application Data

[60] Division of Ser. No. 437,685, May 9, 1995, Pat. No. 5,579,911, which is a continuation-in-part of Ser. No. 341,367, Nov. 17, 1994, abandoned.

[51] Int. Cl.[6] ..... B65D 5/42; B65D 71/12

[52] U.S. Cl. ..... 206/192; 206/427; 229/120.011

[58] Field of Search ..... 206/427, 139, 206/144, 192, 745, 746, 750; 229/101, 117.09, 117.16, 120.01, 120.011, 120.012, 120.11

[56] References Cited

U.S. PATENT DOCUMENTS

| | | | |
|---|---|---|---|
| 2,046,751 | 7/1936 | Reichel | 229/120.011 |
| 2,327,529 | 8/1943 | Kleckhefer et al. | 229/120.011 |
| 2,973,130 | 2/1961 | Cottrill | 229/120.011 |
| 3,099,380 | 7/1963 | Nathan | 229/120.011 |
| 3,135,457 | 6/1964 | Risucci | 229/120.011 |
| 3,158,312 | 11/1964 | Simkins | 229/120.11 |
| 3,853,259 | 12/1974 | Tupper | 229/120.11 |
| 4,913,291 | 4/1990 | Schuster | 229/120.11 |
| 5,178,269 | 1/1993 | Evers | 229/120.11 |
| 5,197,660 | 3/1993 | Colling | 229/120.11 |

FOREIGN PATENT DOCUMENTS

| | | | |
|---|---|---|---|
| 906456 | 8/1972 | Canada | 229/120.011 |
| 1117295 | 6/1968 | United Kingdom | 229/120.011 |

*Primary Examiner*—Jimmy G. Foster
*Attorney, Agent, or Firm*—James R. Young

[57] ABSTRACT

A multi-unit package formed from a one-piece wrapper folded around two groups of products. Each side of the package has cuts or perforations that partially separate the package into two sub-packages; each end of the package has at least one tear-strip aligned with the cuts or perforations; and the top of the package has a handle which allows the package to be carried. The wrapper can be folded so that the two sub-packages are separated by a center divider, having a perforated top. The two sub-packages may also be held together by an adhesive which allows the sub-packages to be separated. Once separated, a handle, hidden before separation, is available for carrying the second sub-package. Another multi-unit package has two sub-packages arranged side by side and connected by perforations in end flaps.

13 Claims, 12 Drawing Sheets

DETACHABLE MULTI-UNIT PACKAGE HAVING INTERNAL HANDLE

CROSS REFERENCE TO RELATED APPLICATIONS

This is a divisional of application Ser. No. 08/437,685 filed on May 9, 1995, U.S. Pat. No. 5,579,911, which is a continuation-in-part of application Ser. No. 08/341,367 of Elmer D. Werth, filed Nov. 17, 1994 and entitled "Detachable Multi-Unit Package Having Internal Handle", abandoned.

BACKGROUND OF THE INVENTION

This invention relates to packaging a plurality of containers and more particularly to a package that can be separated into a plurality of sub-packages. Even more particularly the invention relates to a one-piece wrapper made into a package for holding containers which can be easily separated into smaller sub-packages upon delivery to the retailer, lowering the cost of manufacturing, warehousing, transportation, storage and delivery of containers.

Several different multi-unit packaging systems have been developed for the marketing of a number of packaged products, for example, bottled and canned beverages and other liquid products. Currently, most bottle or can containers are shipped in units of six, generally referred to as the six-pack package. Four six-packs are normally placed together in a paper tray for shipment from the manufacturer to the retail outlet. At present the six beverage containers in a six-pack are typically held together by a piece of plastic having six circular apertures or by a simple wrap-around paperboard package such as that disclosed in U.S. Pat. No. 4,566,593 issued Jan. 28, 1986 to Muller. When a paper tray of six-packs arrives at the retail outlet, the paper tray must be discarded if the containers are to be sold as six-packs. If the retailer would prefer to have two six-packs packaged together as a twelve-pack unit, the manufacturer must establish a different manufacturing line to produce twelve-packs, and twenty four-packs, and all manufacturing, warehousing, transportation, storage and delivery between the manufacturer and the retailer must store the six-packs, twelve-packs, and twenty four-packs separately.

U.S. Pat. No. 3,759,378, issued Sep. 18, 1973 to Werth, attempts to alleviate this problem by providing a container that will hold four six-packs. The container is comprised of a wrapper which wraps around all four six-packs, and has a tear-strip which allows the wrapper to be separated into two twelve-packs. A primary disadvantage of this type of package is that the tear-strip completely surrounds the entire carton, and therefore, the carton must be turned a full 360 degrees in order to remove the tear-strip.

U.S. Pat. No. 3,942,631 issued Mar. 9, 1976 to Sutherland, et al, also addresses the problem of separating sub-packages after they arrive at the retailer. This invention, however, primarily addresses changing the outer carton which contains the six-packs into a display case.

U.S. Pat. No. 4,415,082 issued Nov. 15, 1983 to Martin, partially addresses the problem of shipping multi-unit cartons, each of which contains a liquid. A tear-strip is provided to separate the cartons and the outer wrapper is then used as a handle.

U.S. Pat. No. 2,758,777 issued Aug. 14, 1956 to Dixon, partially address the problem of shipping multi-unit packages. Dixon, however, uses nearly double the quantity of material to form the packages as conventional packaging and this excess material, as well as being costly, significantly complicates the forming machinery necessary to assemble the packages at high speeds. The Dixon package requires a band to hold the packages together, since without the band, the bottom of the packages would separate. Thus the band serves the same function as the tray used with most conventional packages, and has the same cost and disposal problems. Also, once the band is removed, the package can only be separated into four six-packs and cannot be separated into twelve packs.

European Patent Application 0,029,365 Filed Nov. 14, 1980 addresses the problem of holding the sub-packages in a package by forming apertures in the top of the package, but does not address the problem of multi-unit shipping.

U.S. Pat. No. 4,919,269 issued Apr. 24, 1990 to Wright et al. address multi-unit packages wherein the sub-packages are oriented side by side, but fails to provide any handle for carrying either the multi-unit package or the sub-packages after separation.

U.S. Pat. Nos. 5,249,738 issued Oct. 5, 1993 to Werth, and 5,299,733 issued Apr. 5, 1994 to Werth, each address the problem of multi -unit packages containing four sub-packages that can be separated after shipment, wherein the packages are arranged side by side, and have no handles.

Many of the packages described above require disposal of one or more tear strips after the packages are separated.

U.S. Pat. Nos. 5,234,102 issued Aug. 10, 1993 to Schuster et al. and 5,246,113 issued Sep. 21, 1993 to Schuster each disclose a package having two layers of containers, however, neither of these packages is separable into two sub-packages.

U.S. Pat. No. 3,142,378 issued Jul. 28, 1964 to B. H. Lengsfield, Jr. entitled "Separable Carton", and U.S. Pat. No. 3,692,228 issued Sep. 19, 1972 to Spiegel entitled "Unit Dose Device" both address side by side packages that are separable, however, in both these devices, the perforations for separating the packages extend the entire way around the package. Having such a large amount of perforation makes the packages difficult to separate, particularly if the packages contain lighter products, such as, for example, bars of soap.

U.S. Pat. No. 5,197,660 issued Mar. 30, 1993 to Colling, entitled "Twin Package Carton", provides two side by side separable containers wherein glue flaps are separably attached to two top flaps. This container, however, is connected only at the top, and does not form a rigid package, and is difficult to pick up from the bottom.

None of the above described inventions allows two sub-packages to be shipped as a multi-unit package wherein after separation each sub-package has a carrying handle. If the package has the sub-packages stacked on top of each other, it is very inconvenient if one of the sub-packages must be re-oriented after separation, in order for its handle to be on the top, so that it can easily be picked up by a consumer.

There is need in the art then for a versatile package which is manufactured as a one-piece wrapper that holds a plurality of containers together as a single unit, and later can be separated by the retailer into two sub-packages, wherein the sub-packages are stacked one on top of the other. There is further need in the art for a package wherein the wrapper that surrounds the package is the same wrapper surrounding the sub-packages, eliminating the need for any additional wrappers. A still further need in the art is for such a wrapper having stacked sub-packages wherein, when separated, each sub-package has a handle located on a top surface.

SUMMARY OF THE INVENTION

It is an aspect of the present invention to provide a package formed from a single piece of material, capable of containing a plurality of sub-packages that contain cans or bottles.

It is another aspect of the invention to provide such a system that allows a manufacturer to eliminate separate manufacturing production for twenty four-pack, and twelve-pack packages of cans or bottles.

Another aspect of the invention is to eliminate the need for separate warehousing, transportation, storage and delivery of twenty four-pack, and twelve-pack packages.

A further aspect of the invention is to provide such a package typically containing twenty four cans or bottles that can be conveniently separated into two twelve-pack sub-packages.

A still further aspect of the invention is to provide such a package which is formed from a piece of carrier board, recycled paper or other recycled materials, or from A, B, C, D, E, or Super E flute paper corrugated material.

The above and other aspects of the invention are accomplished with a package formed from a wrapper, typically made of a single piece of carrier board, that is folded around a desired number of containers such as twenty-four cans or bottles. Each end of the package has end flaps with glue flaps attached to the end flaps using a tear-strip or perforation. Separating the glue flaps from the end flaps will separate the package into two sub-packages for example, without having to lift and rotate the package.

When the end flaps are connected to the glue flaps with a perforation, a hole is located at one end of the perforation, to allow insertion of a device, such as a tool or a person's finger, to separate the perforation. Additionally, the package is designed to provide a cutout behind each hole to allow insertion of the tool or finger.

The package has a handle on its top, and once separated, a second handle, hidden when the sub-packages were attached, is available for carrying the second sub-package. Each of these handles are reinforced with tape or string to prevent tearing of the handle.

BRIEF DESCRIPTION OF THE DRAWINGS

The above and other objects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
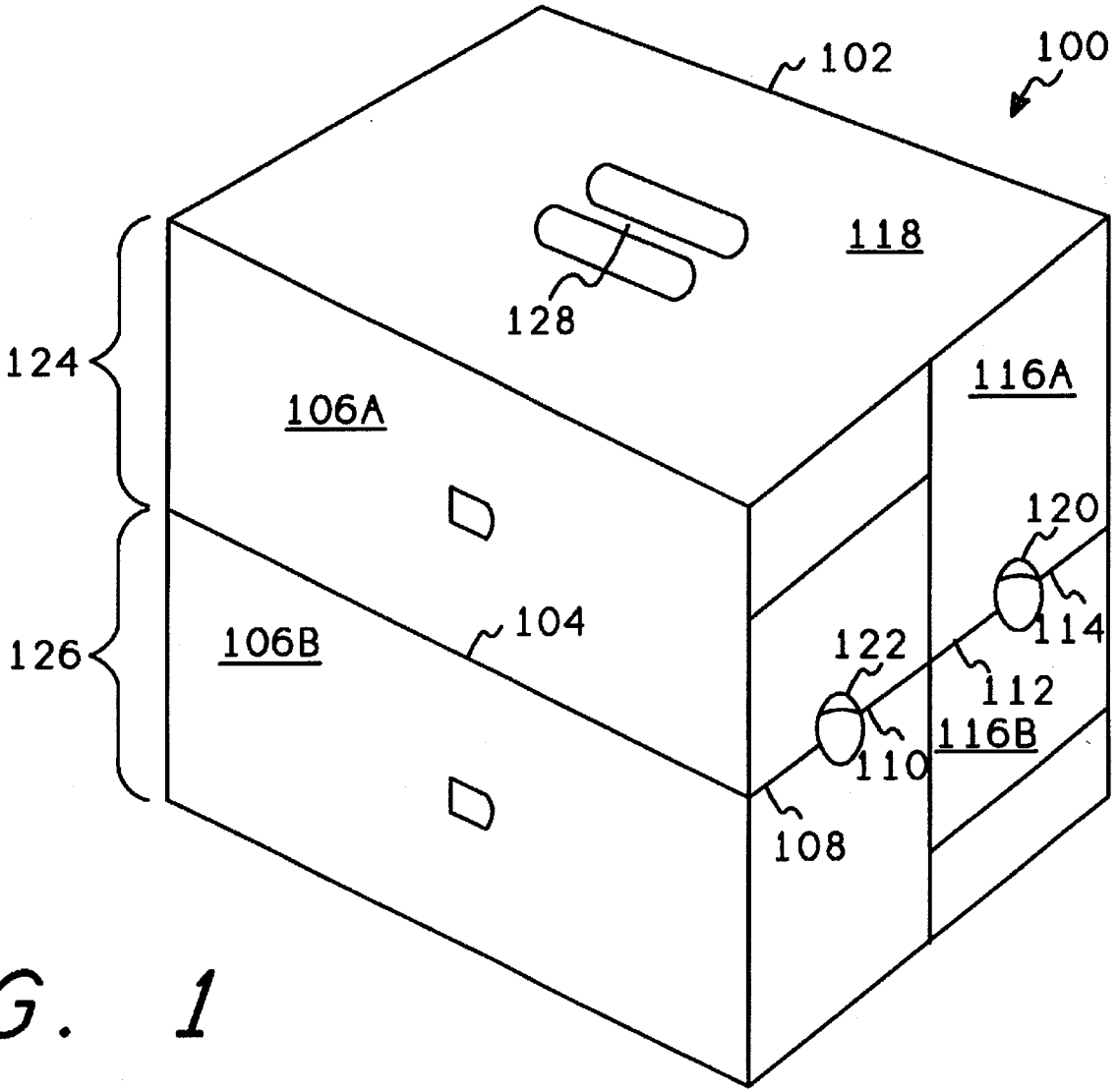
FIG. 1 shows a perspective view of the detachable multi-unit package.

FIG. 1 shows a perspective view of the multi-unit package of the present invention. Referring now to FIG. 1, a package 100 is comprised of a one-piece wrapper 102 which wraps around and contains twenty-four cans or bottles (not shown), arranged in two layers, each layer typically having four rows of three cans or bottles to form a twelve-pack of cans or bottles. Those skilled in the art will recognize, however, that each layer could contain any number of cans, bottles, or other containers. Each layer forms a separable sub-package of containers.

The wrapper 102 has a separation 104 in the package side 106A and 106B which, in combination with a pair of perforations or tear-strips 108 and 114 as well as cuts 110 and 112 in package end 116, and corresponding perforations or tear-strips and cuts in the other package end (not shown in FIG. 1), allow the twenty four-pack package 100 to be split into two twelve-pack sub-packages 124 and 126. In addition, the package may have a perforated divider (not shown in FIG. 1, but illustrated as 502A and 502B in FIG. 5 below) between the two twelve-packs.

Holes 120 and 122 allow a tool, or a person's finger, to separate the perforations 114 and 108, respectively, allowing the carton to be separated into the two sub-packages 124 and 126. Once separated, the upper sub-package 124 and the lower sub-package 126 can be handled identically.

A handle 128 is used to carry the multi-unit package 100. As will be illustrated below, the handle 128 has reinforcing tape or string to allow it to carry the weight of a fully loaded multi-unit package 100.

Figure 2:
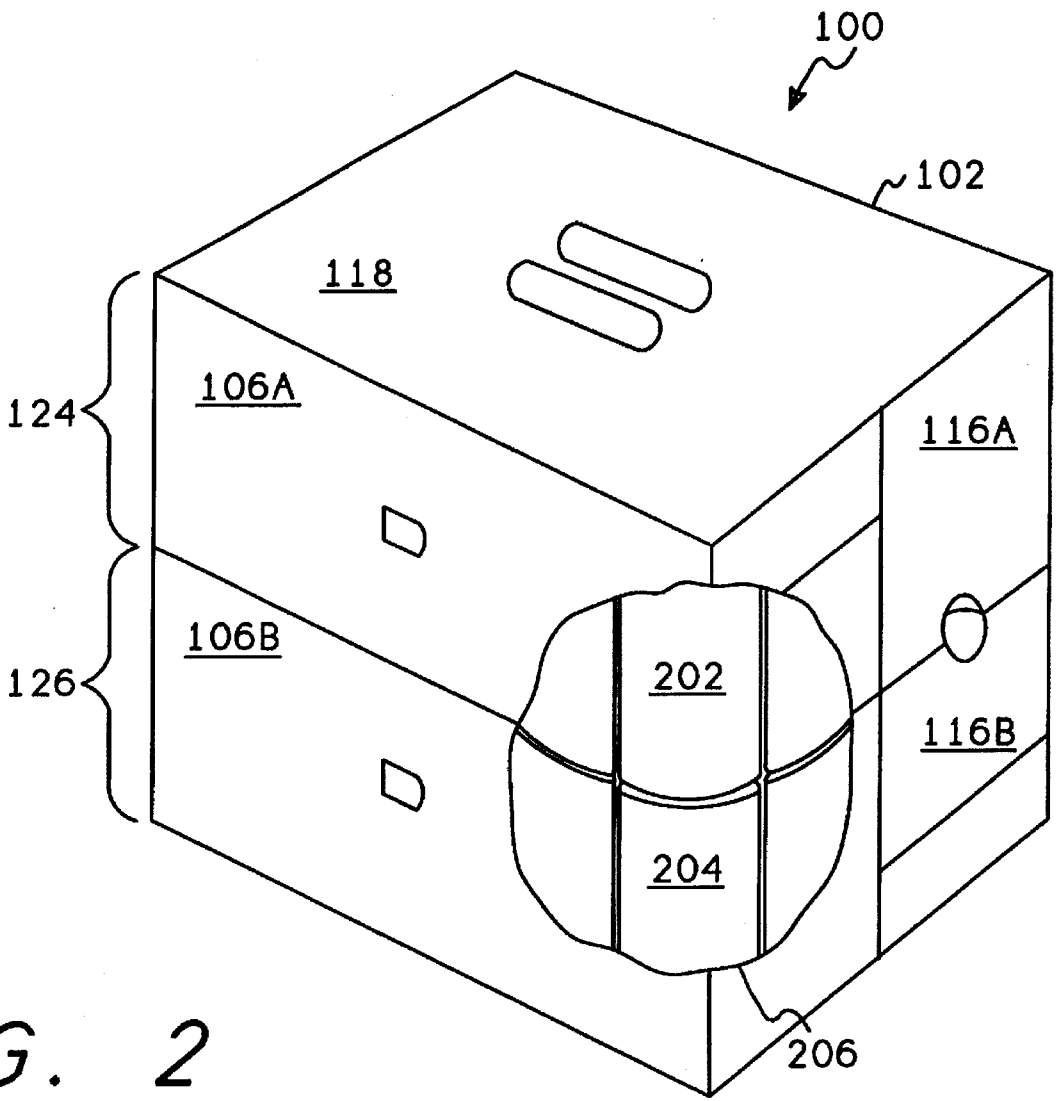
FIG. 2 shows a perspective view and illustrates how cans or bottles are stored in the multi-unit package.

FIG. 2 shows the multi-unit package of FIG. 1, and illustrates how the cans or bottles are arranged within the package. Referring to FIG. 2, the multi-unit package 100 is shown with a cutout 206 illustrating two cans 202 and 204 contained within the multi-unit package 100. Although not illustrated in FIG. 2, the bottom of sub-package 124 and the top of sub-package 126 would be located between the cans 202 and 204. The top sub-package 124 will typically hold 12 cans or bottles, and the bottom sub-package 126 would also typically hold 12 cans or bottles, although those skilled in the art will recognize that each of the top and bottom packages could hold any number of cans or bottles or other type of container.

Figure 3:
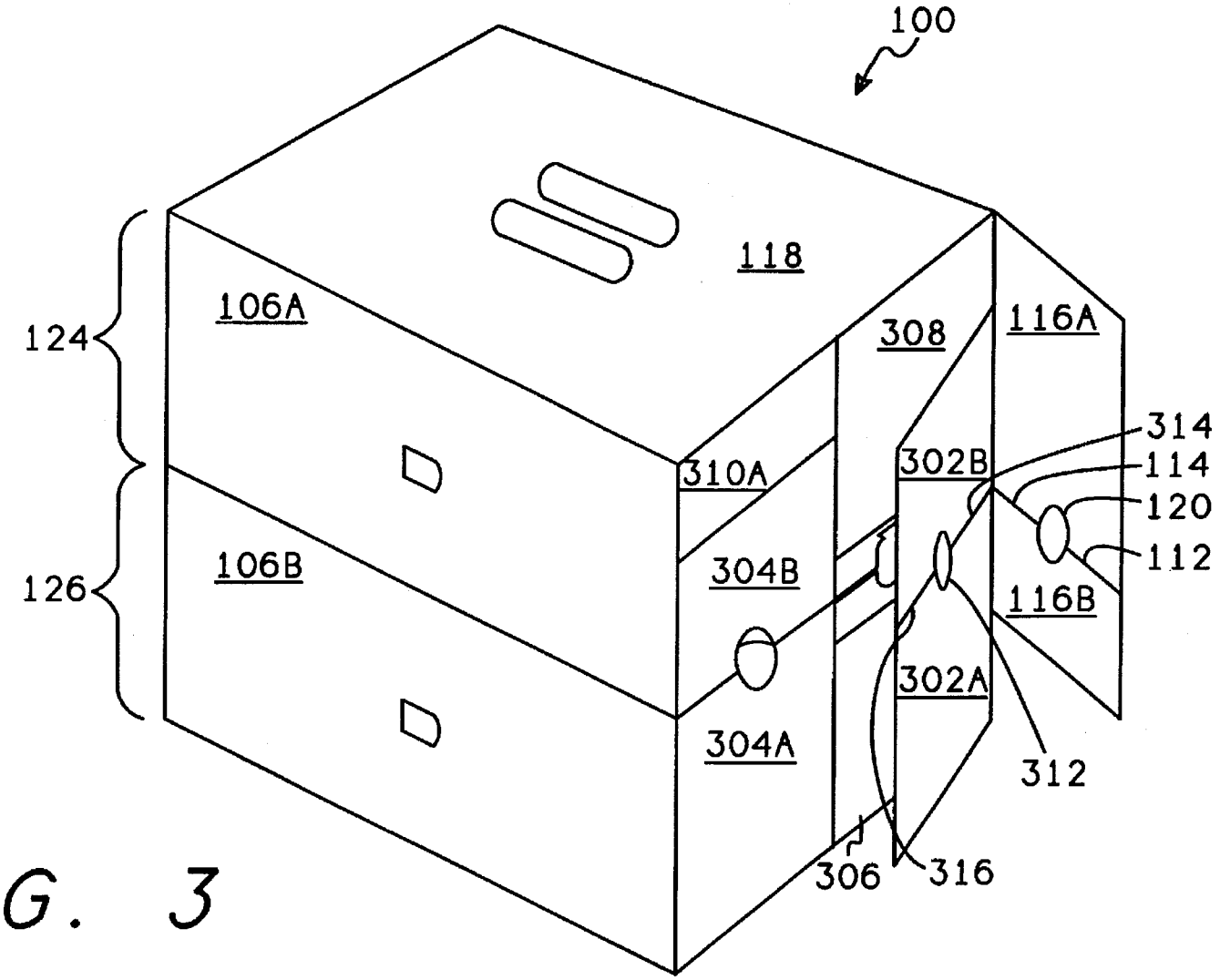
FIG. 3 shows the end flaps partially open to illustrate how the end flaps are folded to cover the end of the package.

FIG. 3 shows the multi-unit package of FIG. 1, and illustrates how the end flaps are arranged. Referring now to FIG. 3, the multi-unit package 100 is shown with end flap 116A and glue flap 116B spread out as they would be before the package is sealed. End flap 116A is connected to the side of sub-package 124, and glue flap 116B is connected, through perforation or tear strip 114, to flap 116A. When the package is sealed, glue flap 116B is attached to sub-package 126, typically using glue. The sub-packages are separated by tearing the perforation or tear strip 114 by placing a tool, or a person's finger, into hole 120 and pulling through the perforation or tear strip 114.

An optional second end flap 302A and glue flap 302B is constructed in the same manner as end flap 116A and glue flap 116B, wherein end flap 302A is connected to a side of sub-package 126, and glue flap 302B is connected, through a perforation 316 to end flap 302A. When the package is sealed, glue flap 302B is attached to sub-package 124, typically using glue. End flap 302A and glue flap 302B have a hole 312 that aligns with hole 120 when the flaps are sealed over the package, to allow the perforation or tear strip 314 to be separated using a tool or a person's finger at the same time perforation or tear strip 114 is separated. Flaps 302A and 302B also have a cut 316, which aligns with the cut 112, when the flaps are sealed over the package.

At the other side of the package, flaps 304A and 304B correspond to flaps 302A and 302B, and a flap 310A corresponds to flap 116A. Although not illustrated in FIG. 3, end flap 310A has a glue flap 310B attached by a perforation or tear strip, in the same manner glue flap 116B attaches to end flap 116A.

If the containers are light enough, only one glue flap may be needed on each side of the package. For example, glue flaps 302B and 310B might be eliminated. Also, the second end flaps, for example 302A and 310A, might be eliminated. For extremely light containers, only end/glue flaps on opposite corners may be needed. Conversely, for heavy containers, glue might be placed between the two sub-packages, in addition to a divider (shown below in FIG. 5).

An end flap 308 is attached to an end of the top 118 of the upper sub-package 124, and this end flap folds down over the cans or bottles, inside the flaps 310A, 304B, 302B, and 116A. Similarly a flap 306 is attached to the bottom of lower sub-package 126 and folds inside, adjacent the cans or bottles.

A set of flaps is located on the other end of the multi-unit package, and this set has flaps corresponding to each of the flaps illustrated above, folded in the same manner.

Figure 4:
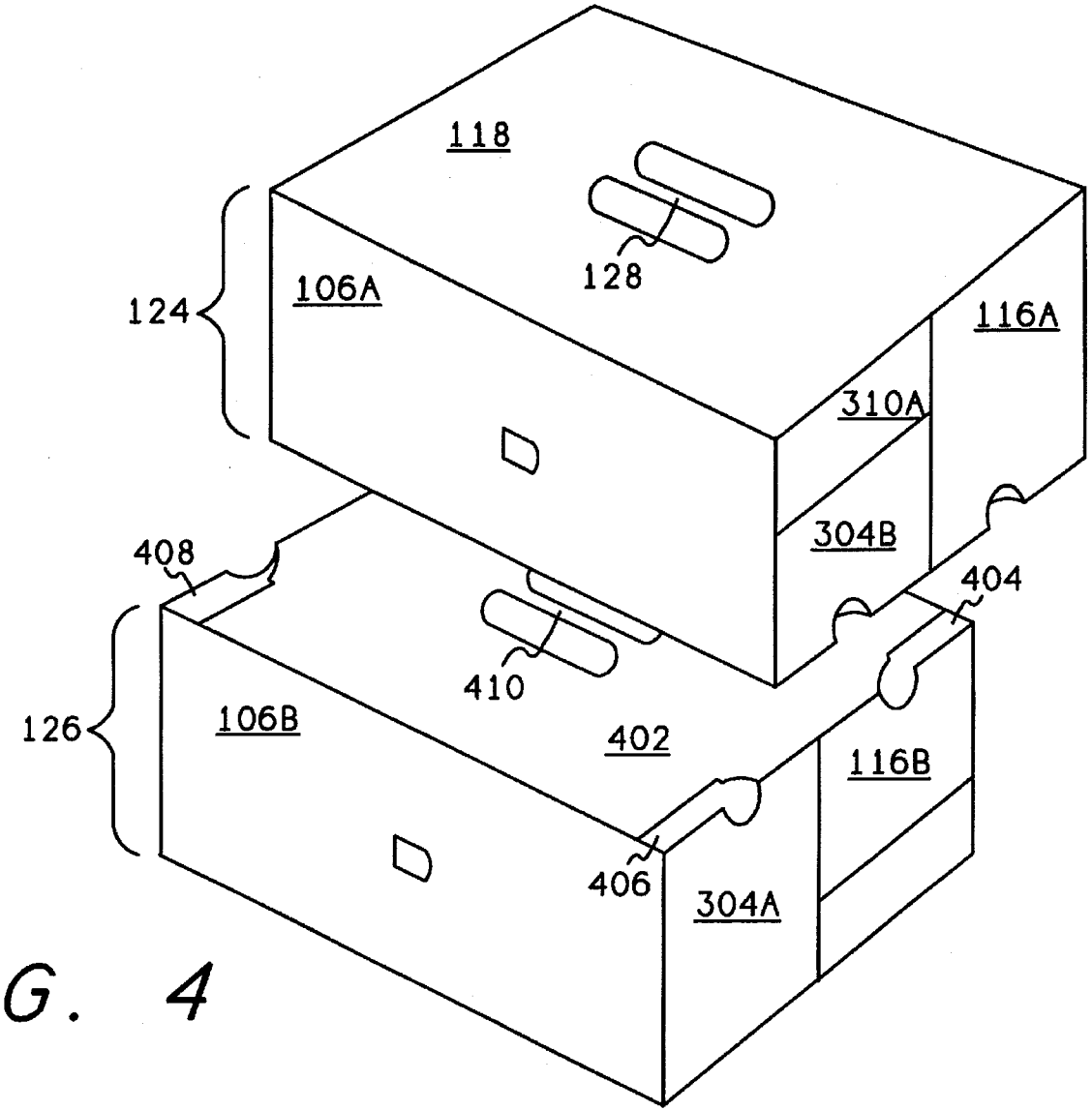
FIG. 4 shows the multi-unit package after the two twelve packs have been separated.

FIG. 4 shows the multi-unit package, after the two sub-packages 124 and 126 have been separated. Referring to FIG. 4, to separate the two sub-packages, flap 116A is separated from flap 116B, and flap 304A is separated from flap 304B. Although not shown directly in FIG. 4, flaps 302A and 302B, are separated at the same time flaps 116A and 116B are separated, and flaps 310A and 310B are separated at the same time flaps 304A and 304B are separated. Also, the flaps on the other end of the multi-unit package 100 are separated in the same manner as the flaps described above.

Once the separation is complete, a second handle 410 is visible, and this handle can be used to carry the lower sub-package 126. An important feature of the invention is that the handle 410 is in the same relationship to the lower sub-package 126 as the handle 128 is to the upper sub-package 124. Thus, when the multi-unit package is placed so that the handle 128 is on the top of the entire package, after separation, both handle 128 and handle 410 will be located on the top of their respective sub-packages.

This view also illustrates cutouts 404, 406, and 408, which provide room for the tool or person's finger to enter the package in order to tear the perforation or tear strips (illustrated in FIG. 3). There is also a fourth cutout 532 (not shown in FIG. 4) for the fourth perforation (not shown in FIG. 4).

Figure 5:
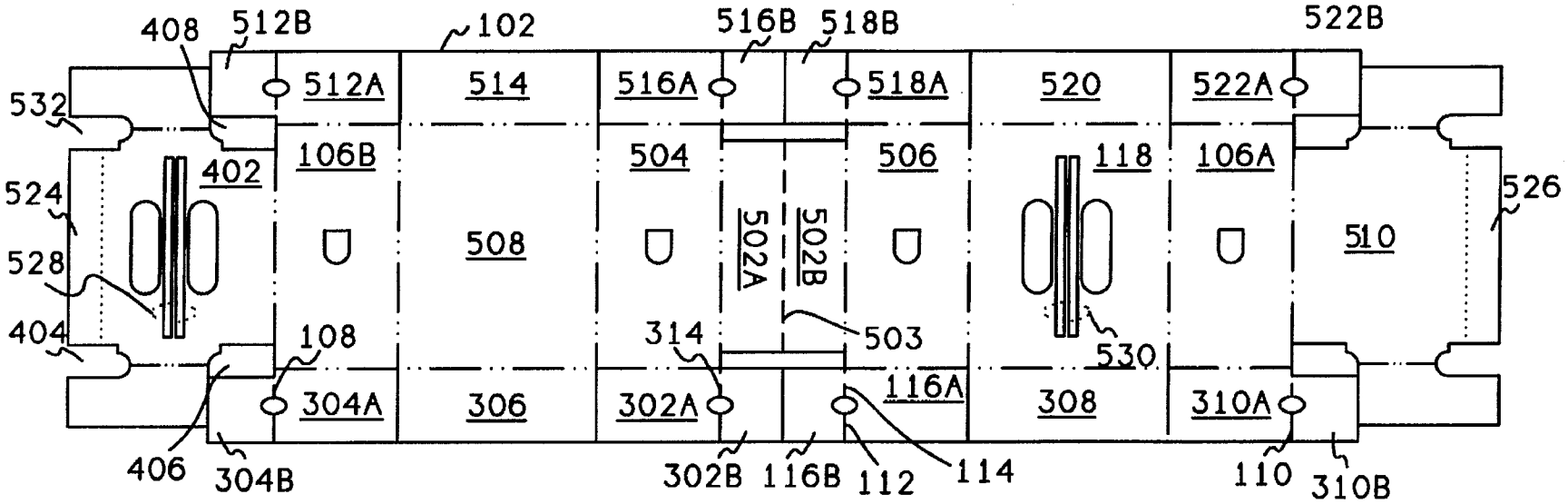
FIG. 5 shows a layout view of one embodiment of the one-piece construction used to form the package.

FIG. 5 shows a layout view of the one-piece wrapper 102. Referring now to FIG. 5, solid lines indicate cuts, dashed lines indicate perforations, and dash-double-dot lines indicate folds. The one-piece wrapper 102 includes a pair of center flaps 502A and 502B which are connected by a perforation 503. The center flaps 502A and 502B fold together and form a divider between the two sub-packages 124 and 126. All components to the right of perforation 503 form the upper sub-package 124, and all components to the left of the perforation 503 form the lower sub-package 126.

Attached to the center flap 502B is side piece 506, which has end flaps 116A and 518A. Attached to the end flap 116A is the glue flap 116B. A perforation or tear strip 114 is used to connect the glue flap 116B to the end flap 116A. Extending outward from the side piece 506 is the top 118, which has flaps 308 and 520 attached. Outward from the top 118 is side piece 106A with flaps 310A and 522A attached. Attached to the side piece 106A is bottom 510, which is the bottom of the upper sub-package 124.

Attached to the center flap 502A is side piece 504, which has end flaps 302A and 516A. Attached to the end flap 302A is the glue flap 302B. A perforation or tear strip 314 is used to connect the glue flap 302B to the end flap 302A. Extending outward from the side piece 504 is the bottom 508, which has flaps 306 and 514 attached. Bottom 508 forms the bottom of the lower sub-package 126. Outward from the bottom 508 is side 106B with flaps 304A and 512A attached. Attached to the side piece 106B is top 402, which is the top of the lower sub-package 126.

Reinforcing strips 528 and 530 are typically made of tape or string, although those skilled in the art will recognize that many different types of reinforcing could be used for the handles.

Cutouts 404, 406, 408, and 532 in the top piece 402 of the bottom sup-packet 126, as well as corresponding cutouts in the bottom piece 510 for the top sub-packet 124, provide space for the tool, or person's finger, to enter the holes and tear the perforations in the end flaps 116A, 302A, 304A, 310A, 512A, 516A, 518A, and 522A.

To form the upper sub-package 124, the wrapper is placed around the cans or bottles so that the area 526 of the bottom 510 is attached, typically by gluing, to the center flap 502B. Similarly, to form the lower sub-package 126, the wrapper is placed around the cans or bottles to that the area 524 of the top 402 is attached to the center flap 502A.

Figure 6:
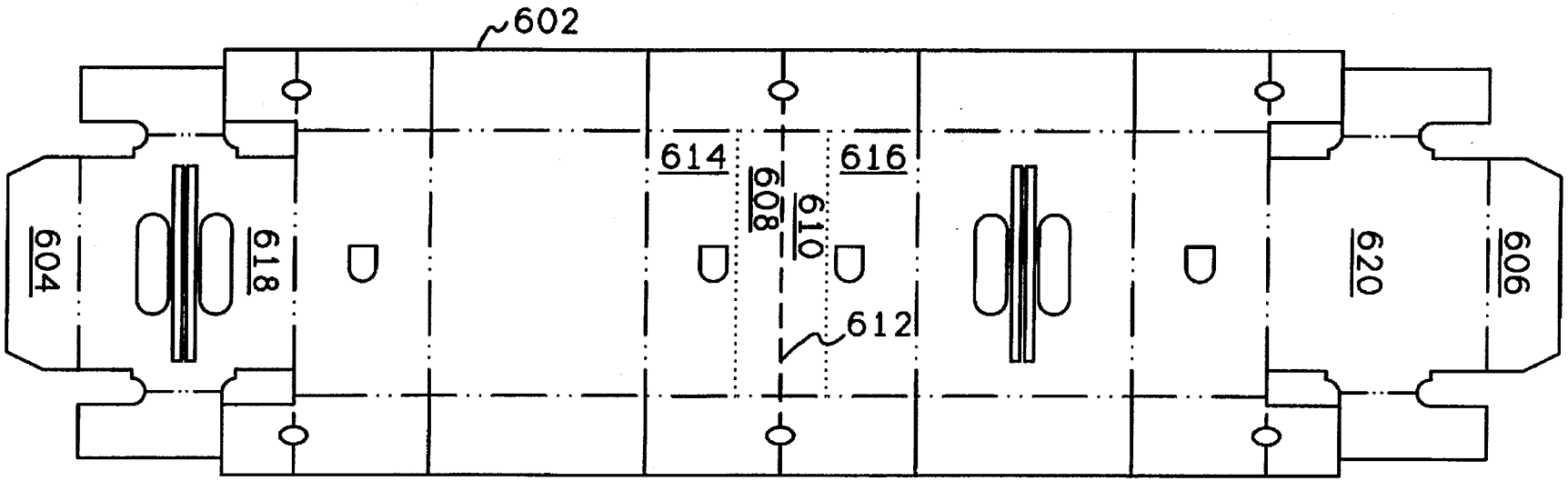
FIG. 6 shows a layout view of a second embodiment.

FIG. 6 shows a layout view of a one-piece wrapper of a second embodiment of the multi-unit package 100, wherein solid lines indicate cuts, dashed lines indicate perforations, and dash-double-dot lines indicate folds. In this embodiment, the center flaps 502A and 502B, shown in FIG. 5, are eliminated, thus the two sub-packages are held together by the end flaps and glue flaps, and the perforations between them. Additionally, the top 618 of the lower sub-package may be glued to the bottom 620 of the upper sub-package. To seal each sub-package, connection flaps 604 and 606 are provided, wherein connection flap 604 is attached to area 608 of the side panel 614, and connection flap 606 is attached to area 610 of the side panel 616 to form the two sub-packages. The two sub-packages may also be connected by a perforation or cut 612.

Figure 7:
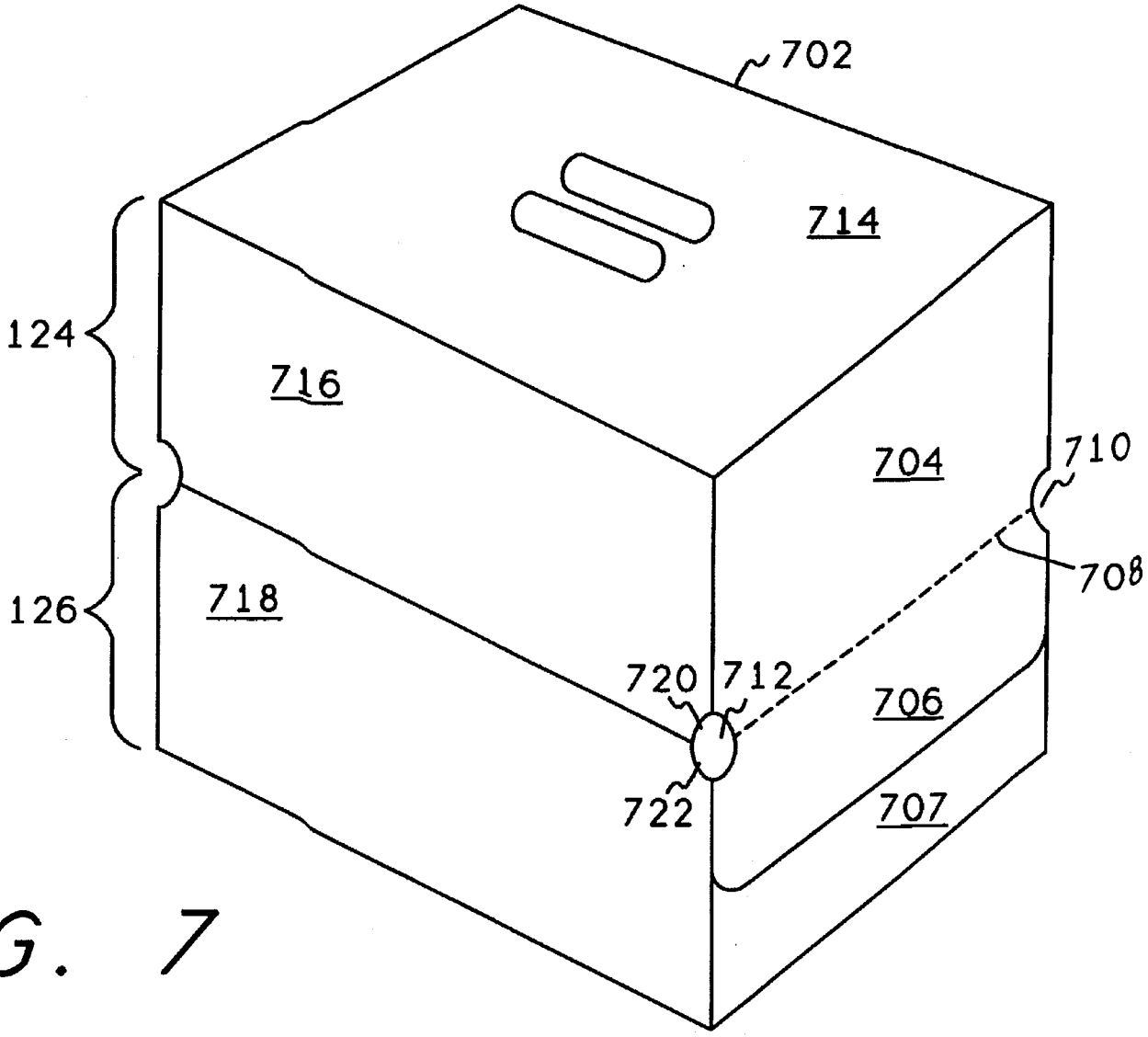
FIG. 7 shows a perspective view of a third embodiment.
Figure 8:
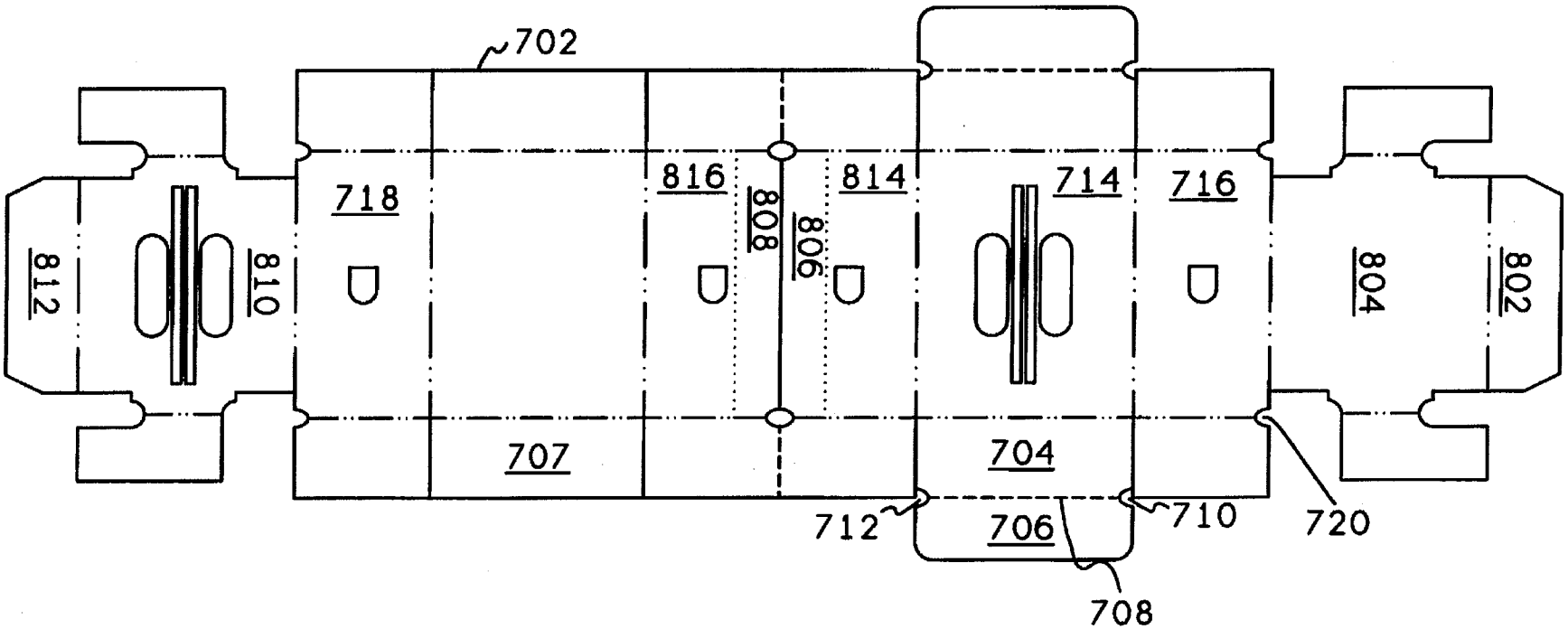
FIG. 8 shows a layout view of the third embodiment.

FIGS. 7 and 8 show perspective and layout views, respectively, of a third embodiment. In the layout view of FIG. 8, solid lines indicate cuts, dashed lines indicate perforations, and dash-double-dot lines indicate folds. In this embodiment, a glue flap 706 is attached to the end flap 704 which is attached to the top 714, instead of attaching glue flaps to the end flaps that attach to the sides of the sub-package. The end flaps attached to the sub-package sides are folded inside flaps 704 and 707, and flap 707 is folded inside flap 704 such that the glue flap 706 is attached to the outside of end flap 707. This embodiment uses the same cutouts in the bottom of the upper sub-package and the top of the lower sub-package as were used in the other embodiments. The holes for this embodiment are cut into the edges of the end flaps, rather than the center, and additional holes are cut into the side pieces so that the tool, or person's finger, can easily be inserted to tear the perforation or tear strip.

To seal each sub-package of the third embodiment, connection flaps 802 and 812 are provided, wherein connection flap 802 is attached to area 806 of the side panel 814, and connection flap 812 is attached to area 808 of the side panel 816 to form the two sub-packages.

Alternatively, glue flap 706 may be attached to end flap 707, so that one glue flap would be formed on each sub-package.

Figure 9:
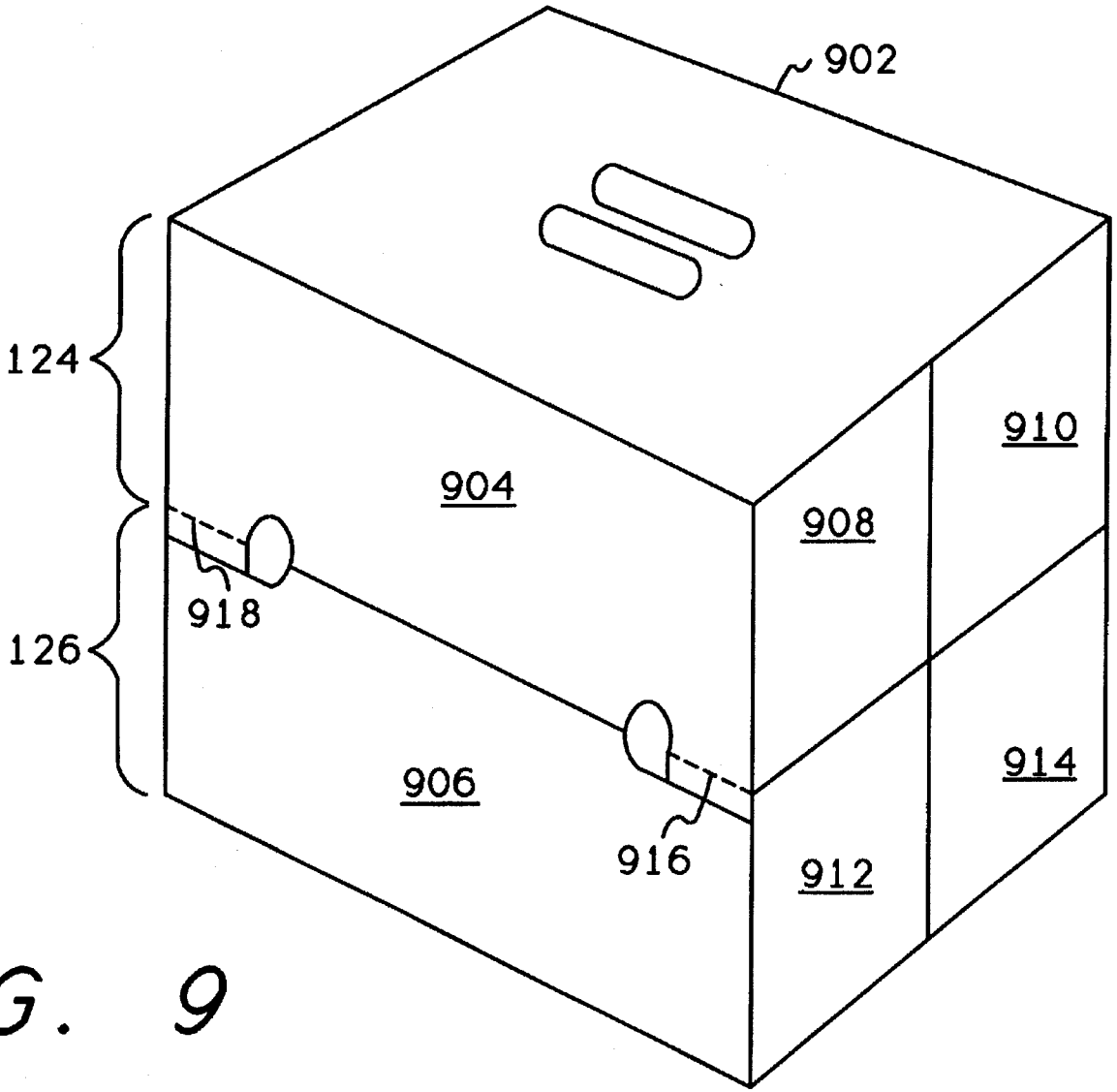
FIG. 9 shows a perspective view of a fourth embodiment.
Figure 10:
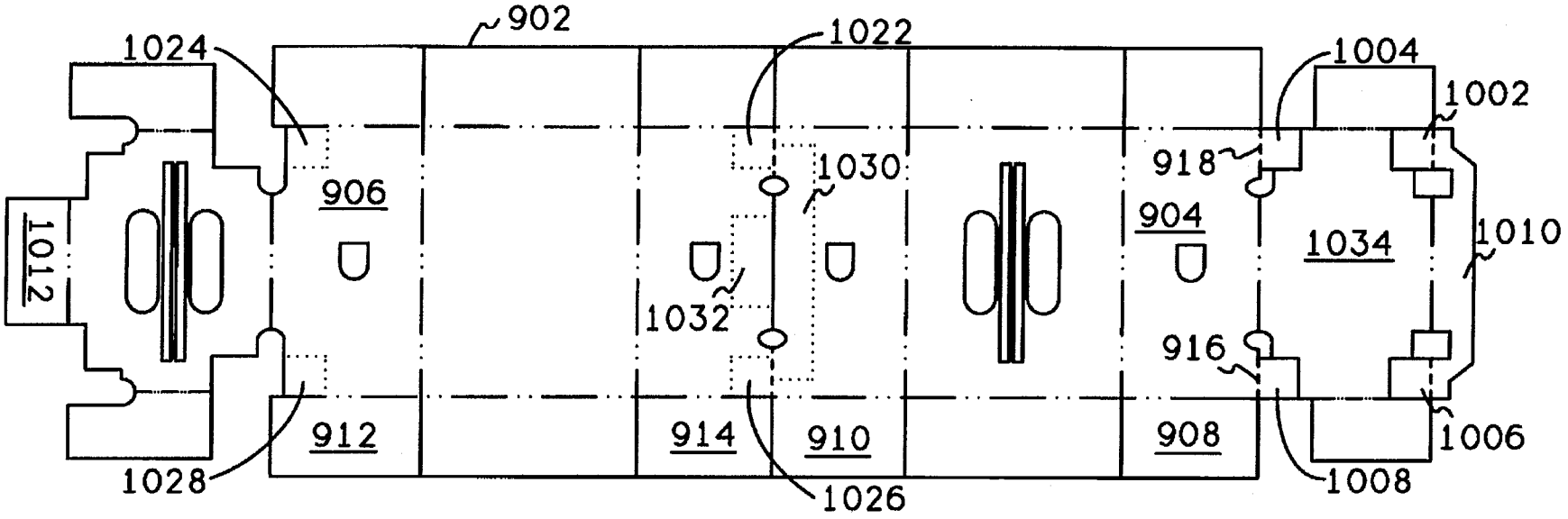
FIG. 10 shows a layout view of the fourth embodiment.

FIGS. 9 and 10 show perspective and layout views, respectively, of a fourth embodiment. In the layout view of FIG. 10, solid lines indicate cuts, dashed lines indicate perforations, and dash-double-dot lines indicate folds. In this embodiment, the attachment between the upper sub-package 124 and the lower sub-package 126 is done within the sides of the package, rather than within the end flaps. The attachment is accomplished using tabs in the upper sub-package bottom 1034 which are attached to the lower sub-package sides. Each tab has a perforation or tear-strip and these perforations or tear-strips are separated by inserting a tool or person's finger into holes in the package side. In addition, sub-package sides 1040 and 1042 have perforations or tear-strips 1026 and 1038 between them which are separated when the sub-packages are separated.

Optionally, the perforations or tear-strips between the sub-package sides 1040 and 1042 may be replaced by cuts, since tabs 1002 and 1006 have perforations or tear-strips. Instead, tabs 1002 and 1006 could be eliminated.

To form the package, tab 1002 is attached to area 1022, tab 1006 is attached to area 1026, tab 1004 is attached to area 1024, and tab 1008 is attached to area 1028. In addition, to form each of the sub-packages, connection flap 1010 is attached to area 1030, and connection flap 1012 is attached to area 1032.

Figure 11:
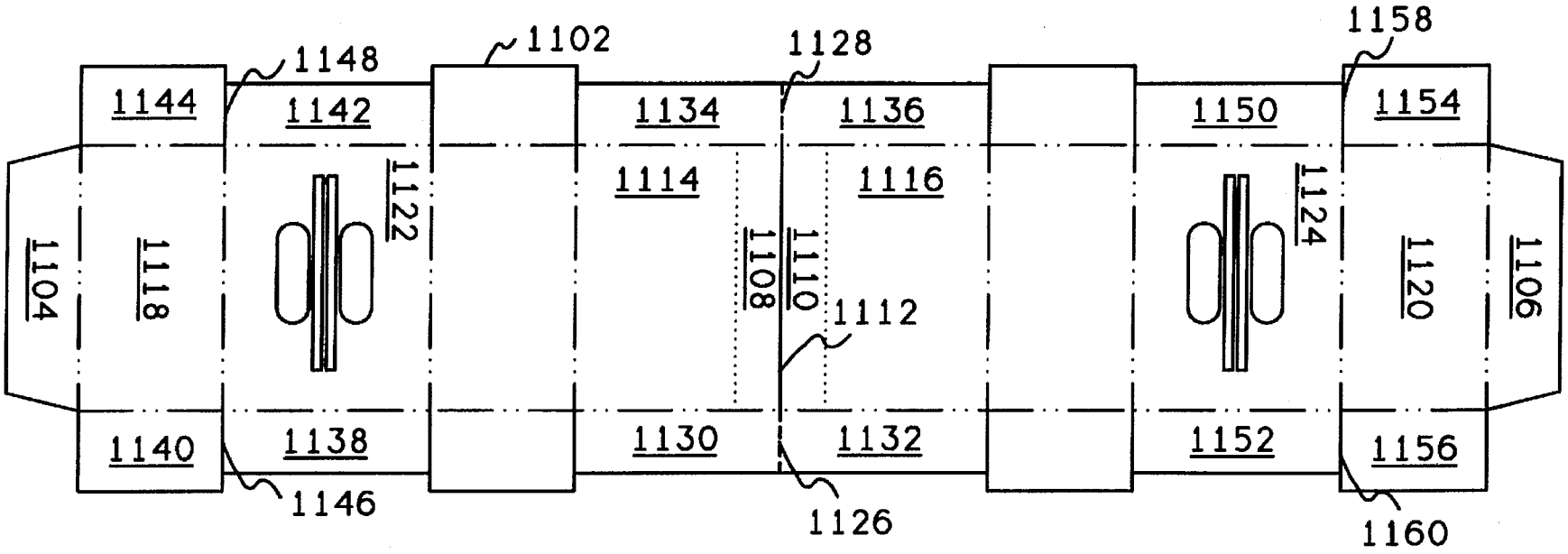
FIGS. 11 and 12 shows a layout and perspective view of a side-by-side arrangement of sub-packages.

FIG. 11 shows a layout view of a one-piece wrapper of an embodiment of the multi-unit package with the sub-packages oriented side-by-side. As in the description above, solid lines indicate cuts, dashed lines indicate perforations, and dash-double-dot lines indicate folds. In this embodiment, the two sub-packages, designated either left and right or A and B, are held together by the separable end flaps 1130, 1132, 1134, and 1136. Flaps 1130, 1132, 1134, and 1136 could be of any length. Separations 1126 and 1128 are typically perforations, but may be any type of separable connection. The separation 1112 is typically a cut, however, it could also be a perforation. Additionally, the side 1118 of the left sub-package may be glued to the side 1120 of the right sub-package. To seal each sub-package, connection flaps 1104 and 1106 are provided, wherein connection flap 1104 is attached to area 1108 of the bottom panel 1114, and connection flap 1106 is attached to area 1110 of the bottom panel 1116 to form the two sub-packages.

In addition, flaps 1140 and 1144 could be separably attached, through perforations 1146 and 1148, to flaps 1138 and 1142 respectively. In this arrangement, flaps 1140 and 1144 would not be attached to side 1118, but would instead be glued to the other sub-package as the package is formed. This would provide another connection between the two sub-packages, for use when the packages contained heavier articles.

Alternatively, flaps 1154 and 1156 could be separately attached to flaps 1150 and 1152 respectively, and be glued to the other sub-package as the package is formed.

As a third alternative, flaps on opposite corners could be separably attached to act as glue flaps. For example, flaps 1138, 1140 and flaps 1150 and 1154 could be arranged this way, whereas the flaps on the other corners would be cut conventionally as described above.

Figure 12:
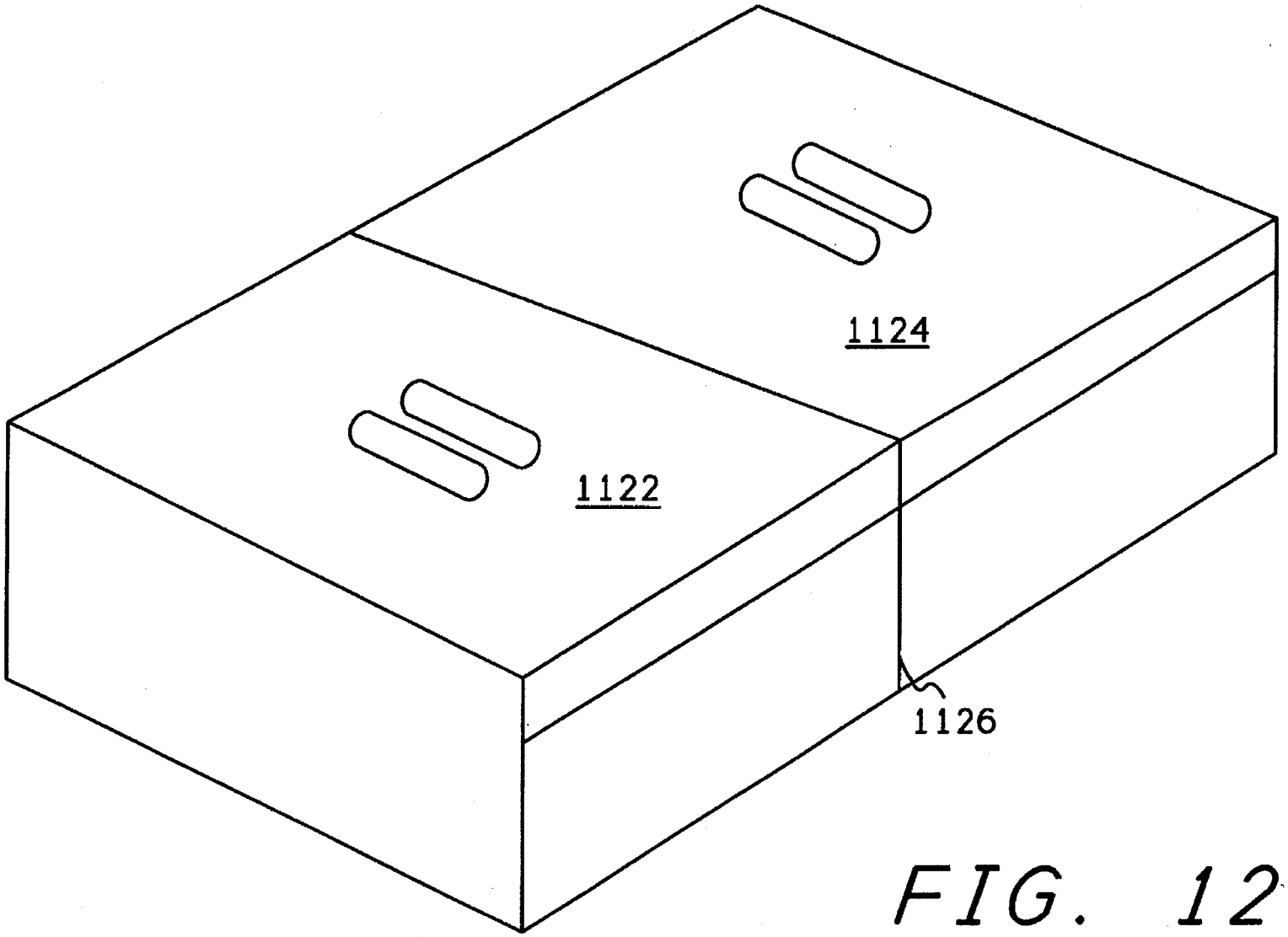

FIG. 12 shows a perspective view of the side-by-side arrangement of the sub-packages.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A package for holding a plurality of containers as a single unit, wherein said package is separable into two sub-packages, said package comprising:

a wrapper having two sections, each section forming a sub-package, wherein each section comprises a sub-package bottom, a first sub-package side connected to said sub-package bottom, a sub-package top connected to said first sub-package side, and a second sub-package side connected to said sub-package top and said sub-package bottom, wherein said package has a wrap-around dimension extending through centers of each of said sub-package sides; and at least two end flaps connected to ends of said package, wherein at least one end flap is connected to an end of said package opposite an end of said package having at least one other end flap connected thereto, and further wherein each of said end flaps has at least one hole and a long dimension oriented parallel to said wrap-around dimension, and still further wherein each of said end flaps has a glue flap separably connected thereto, said sub-packages being connected to form said package by attaching each glue flap on one of said sub-packages to the other of said sub-packages;

wherein when said sub-packages are combined into said package, a bottom of a first of said sub-packages is located adjacent a top of a second of said sub-packages, to hide said top of said second of said sub-packages from view before separation of said sub-packages, and wherein upon separation of said sub-packages, said top of said second of said sub-packages is visible.

2. The package of claim 1 further comprising four cutouts in said bottom of said first of said sub-packages, and four cutouts in said top of said second of said sub-packages, wherein each of said cutouts is located at a corner of said top or bottom.

3. The package of claim 1 wherein said top of each of said sections further comprises a handle usable for holding a sub-package.

4. The package of claim 3 wherein said handle within said top of each of said sections further comprises reinforcing material attached thereto.

5. A package for holding a plurality of containers as a single unit, wherein said package is separable into upper and lower sub-packages, said package comprising:

a wrapper having an upper connection flap, an upper sub-package bottom connected to said upper connection flap, a first upper sub-package side connected to said upper sub-package bottom, an upper sub-package top connected to said first upper sub-package side, a second upper sub-package side connected to said upper sub-package top, a first lower sub-package side separably connected to said second upper package side, a lower sub-package bottom connected to said first lower sub-package side, a second lower sub-package side connected to said lower sub-package bottom, a lower sub-package top connected to said second lower sub-package side, and a lower connection flap connected to said lower sub-package top, and a wrap-around dimension extending through centers of each of said sub-package sides;

four end flaps, one connected to each end of said first upper sub-package side and one connected to each end of said second lower sub-package side, wherein each of said four end flaps has a long dimension oriented parallel to said wrap-around dimension, and wherein each of said end flaps has a glue flap separably connected thereto;

a first pair of end flaps separably connected, wherein a first end flap of said first pair of end flaps is connected to a first end of said second upper sub-package side and a second end flap of said first pair of end flaps is connected to a first end of said first lower sub-package side, wherein each of said end flaps of said first pair of end flaps has a long dimension oriented parallel to said wrap-around dimension;

a second pair of end flaps separably connected, wherein a first end flap of said second pair of end flaps is connected to a second end of said second upper sub-package side and a second end flap of said second pair of end flaps is connected to a second end of said first lower sub-package side, wherein each of said end flaps of said second pair of end flaps has a long dimension oriented parallel to said wrap-around dimension;

wherein said lower sub-package top is hidden when said upper and lower sub-packages are combined into said package, and upon separation of said upper sub-package and said lower sub-package, said lower sub-package top is visible.

6. The package of claim 5 further comprising a plurality of holes, one substantially centrally located between each of said end flaps and said glue flap connected thereto.

7. The package of claim 6 further comprising four cutouts in said upper sub-package bottom, and four cutouts in said lower sub-package top, wherein each of said cutouts is located at a corner of said top or bottom.

8. The package of claim 5 wherein said upper sub-package top and said lower sub-package top each further comprises a handle usable for holding a sub-package.

9. The package of claim 8 wherein said handle within said upper sub-package top and said handle within said lower sub-package top each further comprises reinforcing material attached thereto.

10. A package for holding a plurality of containers as a single unit, wherein said package is separable into two sub-packages, said package comprising:

a wrapper having two sections, each section forming a sub-package, wherein each section comprises a sub-package bottom, a first sub-package side connected to said sub-package bottom, a sub-package top connected to said first sub-package side, and a second sub-package side connected to said sub-package top and said sub-package bottom, wherein said package has a wrap-around dimension extending through centers of each of said sub-package sides; and at least two end flaps connected to ends of said package, wherein at least one end flap is connected to an end of said package opposite an end of said package having at least one other end flap connected thereto, and further wherein each of said end flaps has a long dimension oriented parallel to said wrap-around dimension, and still further wherein each of said end flaps has a glue flap separably connected thereto, said sub-packages being connected to form said package by attaching each glue flap on one of said sub-packages to the other of said sub-packages, and still further wherein each of said end flaps has a hole substantially spanning said separable connection between said end flap and said glue flap, said hole being usable for separating said end flap from said glue flap.

11. The package of claim 10 wherein said top of each of said sections further comprises a handle usable for holding a sub-package.

12. The package of claim 11 wherein said handle within said top of each of said sections further comprises reinforcing material attached thereto.

13. The package of claim 10 wherein when said sub-packages are combined into said package, a bottom of an upper of said sub-packages is located adjacent a top of a lower of said sub-packages, to hide said top of said lower of said sub-packages from view before separation of said sub-packages, and wherein upon separation of said sub-packages, said top of said lower of said sub-packages is visible, said package further comprising four cutouts in said upper sub-package bottom, and four cutouts in said lower sub-package top, wherein each of said cutouts is located at a corner of said top or bottom.

* * * * *